United States Patent [19]

Marass

[11] 4,164,349

[45] Aug. 14, 1979

[54] SHEET FEEDER WITH A SIDE PULLING MARK

[75] Inventor: Josef Marass, Seehausen, Fed. Rep. of Germany

[73] Assignee: Georg Spiess GmbH, Gersthofen, Fed. Rep. of Germany

[21] Appl. No.: 842,940

[22] Filed: Oct. 17, 1977

[30] Foreign Application Priority Data

Oct. 22, 1976 [DE] Fed. Rep. of Germany ..... 2647795

[51] Int. Cl.[2] ..... B65H 9/16

[52] U.S. Cl. ..... 271/250

[58] Field of Search ..... 271/237, 250, 252

[56] References Cited

U.S. PATENT DOCUMENTS

| | | | |
|---|---|---|---|
| 2,167,823 | 8/1939 | Backhouse | 271/250 |
| 2,256,823 | 9/1941 | Battey | 271/250 |

*Primary Examiner*—Richard A. Schacher

*Attorney, Agent, or Firm*—Max Fogiel

[57] ABSTRACT

A sheet feeding arrangement with a side pulling mark for subsequent sheet alignment, in which at least one pulling element actuated cyclically with the sheet feeder and moving back and forth transversely to the direction of sheet movement, grasps the sheet to be aligned and pushes it against a stop strip. The pulling element is in the form of a suction grip located beneath the sheet to be aligned. The suction grip is kept movable on a bearing member moving back and forth transversely to the sheet feeding direction. The bearing member has a stop located forward in the pull direction, and is assigned to the suction grip. The latter can be returned to its stop position after each deflection by a spring acting in the pull direction. This spring is adjustable, and the suction grip has a suction cup which is rotatable about its axis. The suction cup is also movable perpendicular to the plane of the sheet. The suction grip is pivotably mounted on the bearing member.

20 Claims, 4 Drawing Figures

SHEET FEEDER WITH A SIDE PULLING MARK

BACKGROUND OF THE INVENTION

The present invention relates to a sheet feeder with a side pulling mark for subsequent sheet alignment, which is provided with a stop strip and with at least one pulling element actuated in the rhythm (cycle time) of the sheet feeder and moving back and forth transversely to the sheet run direction; this pulling element grasps the sheet to be aligned and pushes it against the stop strip.

With known arrangements of this type the sheet to be aligned is clamped mechanically from the top and bottom between two pressure surfaces and then moved to the side. As a rule, this is done by an up and down moving, freely rotating roller and a counter rail which can contact the roller and moves transversely to the run direction. There also have been known arrangements where two rollers act jointly to form the pressure surfaces grasping the sheet to be aligned. Since, however, the pressure forces required to ensure reliable sheet transport depend on the weight of the material to be handled, when processing thick or large-size and hence heavy material, there results great stress on the sheet to be aligned which may lead to permanent material deformations and visible clamping marks or traces. Particularly when processing cardboard or corrugated cardboard experience shows this to be very difficult, since even small pressure forces are sufficient to permanently deform the material.

Another important shortcoming of the known arrangements is that the sheet to be aligned must be equally accessible during the pulling process from both sides, i.e. from above and below. However, since the sheets arrive on the feeder table not individually, but in a so-called fish-scale like pattern, the sheet alignment can be started only when the overhanging end of the preceding sheet is pulled from the region of the side pull mark and is pulled into the following processing machine. Because of this waiting period there remains only a relatively short waiting period for the side alignment. Therefore, the control curves for controlling the pulling elements must have very steep start-up surfaces which with the present hourly runs impairs the stability and safety of operation. Also, because of these waiting periods it is not possible to feed sheet after sheet without gaps. With sheet feeders working with printing presses, the cylinder circumference which cannot be used in the area of the pit reduces this disadvantage; however, with "Raschier" machines such a gapless sheet sequence is not only desirable, but necessary to avoid dirtying or damaging of the sheet guide rollers, etc.

The known arrangements can be modified, of course, from the so-called pull motion to a push motion, to align heavy sheets by pushing from the side. But aside from the construction expense there is the danger that the slide (push) motion results in the sheet fore edge from the forward marks. Also, the push element may collide with the subsequent sheet.

Therefore, arrangements as known from German Pat. No. 617,605 have been used where disks are driven at sheet speed and located in associate recesses in the feeder table; these disks have an eccentric suction nozzle which pull the sheet above them by applying a vacuum and move it, depending on their distance from the axis of rotation, in parallelogram fashion forward and to the side and deposit it at the forward and side marks. To form the forward and side marks, the known arrangement has merely a simple stop strip. The known arrangement grasps the sheet to be aligned exclusively from the bottom so that accessibility from above is not necessary. Exact sheet alignment, particularly, laterally, is not possible with such arrangements since the edge position of the individual sheets differs widely, so that with the known arrangement which only permits sheet displacement by a fixed amount, this difference is present also in the area of the side marks. There is the danger that relatively far displaced sheets are not brought all the way to the stop and therefore cannot be aligned, and that less displaced sheets cause crumpling in the area of the stop strip. The resulting disadvantages regarding the possible work result are eminent. Also, the known arrangement leads to relative motions between the held sheets and the rotating disks. It must be feared that even this leads to crumpling, etc. Also, air guidance and control is relatively difficult with the known arrangements.

It is, therefore, the object of the present invention to provide an arrangement where with relatively simple and inexpensive means, a careful and still reliable treatment of the sheet is achieved, without regard to the material thicknesses to be processed; at the same time, a gapless sheet feeding is ensured, in addition to increased hourly output.

Another object of the present invention is to provide an arrangement of the foregoing character which may be economically maintained in service and which has a substantially long operating life.

SUMMARY OF THE INVENTION

The objects of the present invention are achieved by providing that the pulling element is a suction grip located underneath the sheet; this grip is kept movable on a bearing piece moving back and forth transversely to the sheet feed direction. These measures permit a simple construction and, without additional means, a reliable and still careful sheet alignment, regardless of the sheet displacement and the material thickness. The suction grip in accordance with the invention grasps the sheet only at its bottom side so that alignment is initiated already at a time when the preceding sheet still covers a major portion of the sheet to be aligned. The resulting time gain permits a relatively slow operation of the side pull mark, and hence relatively flat control curves so that relatively high hourly rates can be handled. Because of the suction connection between the sheet to be aligned and the pulling element, there results extensive relief on the sheet material and hence a careful and still reliable operation. Since, with the arrangement of the present invention, the suction grip provided as pulling element has a certain degree of freedom relative to the back and forth movement of the bearing pieces holding it, there results virtually an automatic termination of the pulling motion as soon as the sheet edge of the sheet to be aligned has reached the stop strip, even if at this instant the forward motion of the back and forth bearing piece is not yet finished but is continued till it reaches the reversal point. Hence, sheet crumpling is not apt to occur. On the other hand, the maximum pull path can be chosen so large that any possible sheet displacement can be handled. From this aspect also a safe and careful operation results. This also has a positive effect on the stack pre-setting and control.

The bearing piece can be used to achieve a definite start position of the grip movement and to assure maximum freedom of movement with a stop forward in the pull direction and associated with the suction grip. The slidable suction grip during any deflection can be returned to its stop position by means of an adjustable spring acting in the pulling direction. As a result, there is maximum deflection possibility of the suction grip for any pulling process. The adjustability of the return spring allows adaptation of the force to be overcome to bring about relative motion between grip and bearing piece to the individual case conditions; i.e., the thickness and stiffness to the material to be processed. The underpressure applied to the sheet can be maintained unchanged.

In accordance with another embodiment of the invention, the suction grip may have a freely rotatable suction plate. This makes possible a sheet pivoting, without relative motions between the sheet to be aligned and the suction device applied.

In another embodiment of the invention, the suction plate of the suction grip may be movable perpendicular to the sheet plane. It is possible to lower the suction plate of the suction grip, when the bearing piece goes back, below the sheet plane, thus avoiding touching and braking.

This can be achieved in a simple manner by having the suction grip tiltable on the bearing piece. The bearing piece may have a guide rod on which a guide bushing, connected to the suction grip, rotates freely and can be moved back and forth. The downward tilt motion of the suction grip can be by its own gravity. Here the suction plate of the suction grip is laterally displaced relative to the guide bushing, so that a sufficient tilt moment results. When the vacuum is turned on, the gripper automatically grasps the sheet to be aligned. To simplify the air guidance, the guide rod may be provided with an internal air guide channel which discharges into the annular space enclosed by the guide bushing.

An alternative inexpensive embodiment to accomplish suction device freedom in the direction perpendicular to the sheet plane can have the suction grip as a so-called jump suction device. With this embodiment there is a necessary up and down motion of the suction plate. The vacuum, present to achieve the suction, is used to advantage.

In accordance with another embodiment of the invention, the bearing peice can be supported parallelogram-like on two parallel rocking levers. A suspension of this type is not likely to attract dirt and dust and thus requires little maintenance. Still the bearing piece is always aligned exactly horizontal. The back and forth motion can be brought about in a simple manner by having at least one of these rocking levers act with a control curve (cam) driven at machine speed. This provides easy adjustment and resetting.

Also, in the region of the suction grip above the sheet track, there may be a cover mask moving up and down with the cycle. The sheet to be aligned during grasping by the suction grip of the invention can be held down in a defined position. On the other hand, the up and down motion facilitates the pulling in and pulling off. The cover mask may be connected to the stop strip which may be actuated by means of a lever controlled via a cam. These measures permit a simple space saving arrangement.

In a further embodiment, there may be a control slide in the air duct whose control piston may be actuated by means of a rocker arm acting with another control cam. This ensures the aimed vacuum application of the suction grip with simultaneous continuous operation in the area of the vacuum generation.

To achieve a simple and yet compact construction, in another embodiment, all control disks may be located on a common single-revolution shaft.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
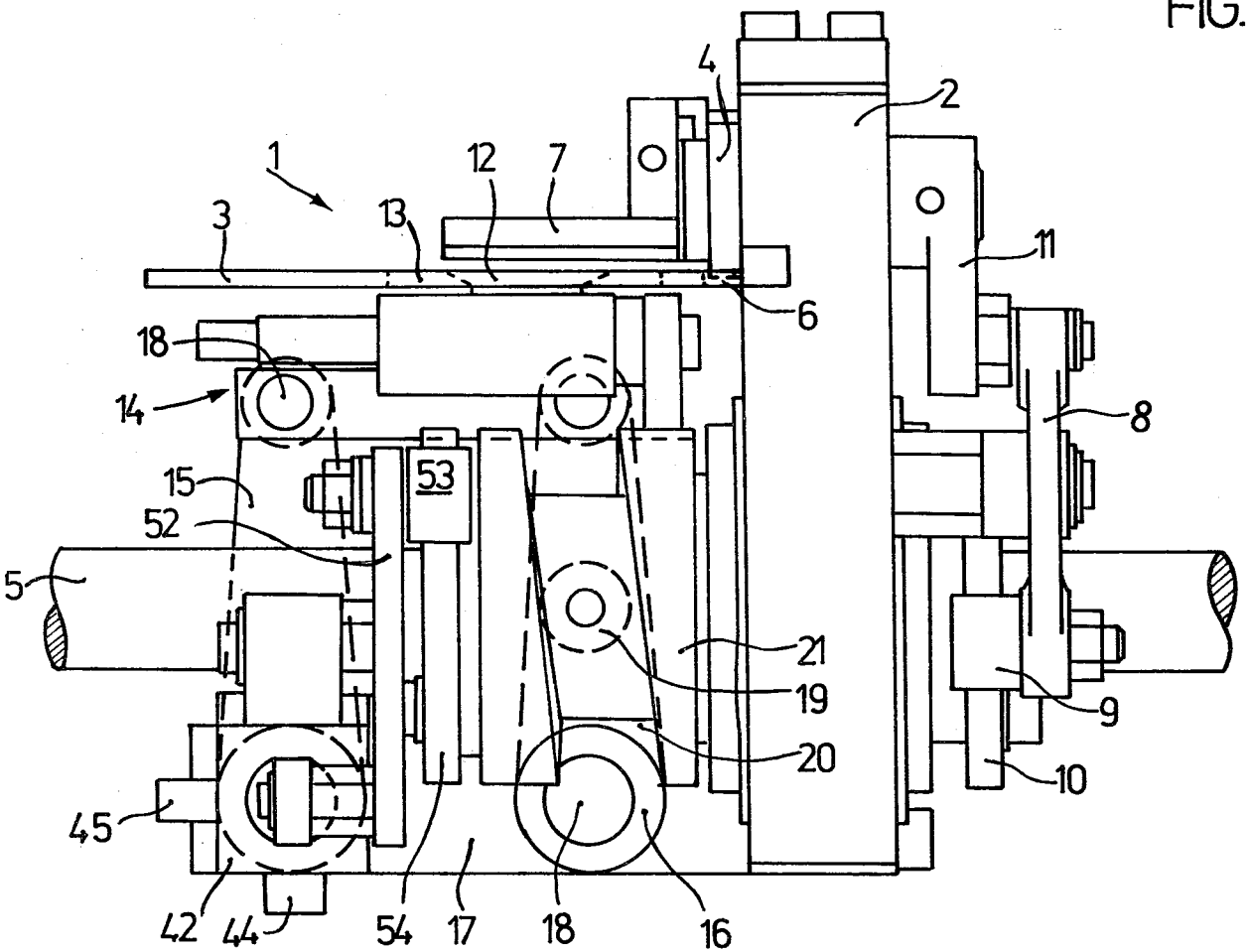
FIG. 1 shows a view of a preferred embodiment seen in the direction of sheet movement.

The side pulling mark shown in FIG. 1 and denoted by 1 has a relatively stable housing plate 2 to which a supporting sheet iron 3 and a stop strip 4 for the sheet to be aligned are attached. The housing plate 2 is adjustable on the table structure of the feed table of a sheet feeder (not shown in detail) in such a way that its supporting sheet 3 is in line with the table top and the stop strip 4 is perpendicular (orthogonal) to the front marks of a sheet processing machine following the feeder. As a rule, such a side pulling mark is provided on both sides of the feed table so that an alignment can be made to the left or right. The drive torque for the moving parts of the side pulling mark 1 is taken off a single revolution shaft 5 rotating at machine speed, which is also located in the housing plate 2.

The supporting sheet 3 is provided in the area of the housing plate 2 with a wall parallel recess which can accommodate the lower edge of the stop strip 4 that is mounted on the housing plate 2 to move up and down. To keep the sheet down, the stop strip 4 may be provided with a cover mask 7 formed by an angle sheet iron and aligned parallel to the supporting sheet 3. To actuate the stop strip 4 rigidly connected to the cover mask 7, there is rocker arm 8 mounted on the housing plate 2; this rocker arm with a roller 9 attached thereto scans a control disk 10 driven by the single-revolution shaft 5 and acts form-locking with a swivel arm 11 engaging the stop strip 4. This drive mechanism for the stop strip 4 may be located to advantage on the outside of housing plate 2. This results in a particularly well-arranged construction.

The sheet edges of the sheets entering between the supporting sheet 3 and the cover mask 7 are guided by a suction grip 12, acting only from below, to the stop strip 4 and aligned there. The suction grip 12 runs in another recess 13 of the supporting sheet 3 which extends in the pull direction, i.e., at right angles to the first recess 6 or to the stop strip 4. The suction grip 12 is accommodated by a bearing piece 14 which moves back and forth in the pull direction at a fixed amplitude and is located underneath the supporting sheet 3. The bearing piece 14 in turn is hinged to two parallel rocking levers 15 and 16 which are turnable in timewise deflection. The rocking levers 15 and 16 are rotatable on a bearing rail 17 flanged at an angle with the housing plate 2. This results in a parallelogram-like pivot system so that the bearing piece 14 holding the suction grip 12 during each rocking lever deflection, always remains parallel to the support sheet 3. To form the upper and lower pivot bearing of the rocking levers 15 and 16, bearing trunnions with properly covered and thus dust-proof mounting bearing points, are provided as suggested at 18. One of the rocking levers, in the embodiment shown—the rocking lever 16 on the right, is equipped with a scanning roller 19 which, to effect the time deflection of the system holding the suction grip 12 and comprising the bearing piece 14 and the rocking levers 15 and 16, scans a control curve 20 of a control disk 21 driven by the single-revolution shaft 5. The position of rocking levers 15 and 16, suggested in FIG. 1, corresponds to an approximate midway pivot position. The control curve 21, as shown, may be a bell-shaped groove in which roller 19 moves with a small amount of play. Without any further measures, such as compression springs, etc., a reliable roller contact is ensured and the hazard of spring vibrations, etc. is effectively avoided.

The control curve 21 permits rocking levers 15 and 16 and hence also bearing piece 14, holding suction grip 12, to have a fixed travel. Since the sheets to be aligned arrive on the supporting sheet 3 with different lateral distance from the stop strip 4, different pulling travels are required, for example; therefore the suction grip 12 in accordance with the invention is provided with a suitable degree of freedom relative to the bearing piece 14 holding it and having a fixed amplitude. Hence the suction grip 12 can be stopped at virtually any point of the reciprocating motion traversed by bearing piece 14 without having to stop the bearing piece 14 itself. For this purpose a suitable straight-line guide permitting free movement of the suction grip 12 on the bearing piece is provided.

Figure 2:
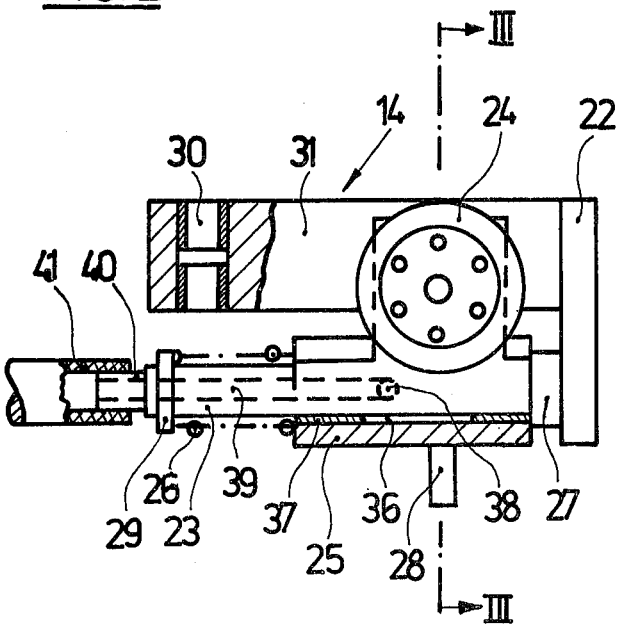
FIG. 2 shows in detail an expedient installation of the suction grip in accordance with the invention.

As shown in FIG. 2, the bearing piece 14 may have a guide rod 23 screwed to a flange 22; on this guide rod, the suction grip 12 with a bushing (sleeve) 25 carrying its suction plate 24 is freely movable. The bushing 25 is pressed by a relatively light spring 26 acting in the pull direction against an associate stop 27 which restricts the suction grip position most forward in the pull direction. This position, suggested in FIG. 2 is held by the suction grip 12 at the start of the pull process. However, as soon as the edge of the sheet held by suction plate 24 contacts the associate stop strip 4, the suction grip has the possibility to remain with the sheet contacting stop strip 4 in contrast with the bearing piece which continues to move towards stop strip 4; the stop 27 is vented and the return spring 26 is compressed. The force of spring 26 corresponds to the pressure force with which the already aligned sheet is kept in contact with the stop strip 4. The suction grip 12 holding the sheet which contacts the stop strip 4 remains stationary, unlike bearing piece 14, to avoid crumpling the sheet. To adapt this pressure force to the conditions of the material at hand, an adjusting facility for the spring tension is provided. As shown in FIG. 2, spring 26 may be a compression spring enclosing guide rod 23. In this case, adjustability of the effective spring tension is achieved simply by making the rear spring stop 29 an adjusting ring. It is also possible to provide a tension spring to be attached to the pin indicated at 28.

Figure 3:
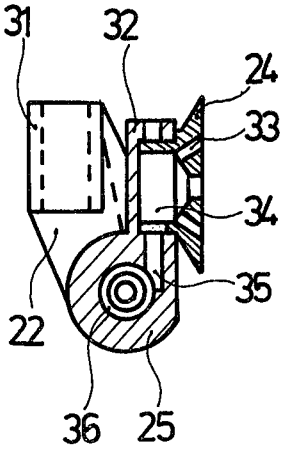
FIG. 3 shows a section taken along line III—III in FIG. 2.

As seen in FIG. 2, the preferred rod bushing guide ensures not only free displacement, but also free rotation of bushing 25 of suction grip 12 around the associate guide rod 23. Consequently, the suction grip 12 of the present invention, after ending one operating stroke during which it is in suction contact with the underside of the sheet to be aligned, may pivot into a rest position in which its suction plate 24 is lowered beneath the surface of the supporting sheet 3 receiving the side edges of the sheet to be aligned. This additional degree of freedom of the suction grip 12 of the present invention ensures that the suction plate 24 or a usually mounted edge-line rubber, after terminating the pulling process, disengages from the sheet lying on the supporting sheet 3. The mentioned pivot (tilt) motion, particularly with very rapidly operating arrangements, may be controlled by rocker arms, etc. In the particularly simple embodiment shown, the pivot motion, in the absence of suction contact, is automatic through gravity. The bushing 25 is located on the guide rod 23 with such easy action, that the suction plate 24 at the start of the next cycle, attaches itself automatically to the underside of the sheet now to be aligned as soon as the vacuum necessary to produce suction contact is turned on. To achieve sufficient pivot torque and sufficient pivot angle and hence reliable plate lowering, the suction plate 24 is slightly offset laterally relative to bushing 25. To restrict this pivot motion, a stop may be provided. In the embodiment shown in FIG. 3, the pivot motion is restricted by having the suction plate (cup) 24 contact a rail 31, provided with bearing holes 30 for connecting rocker arms 15 and 16, of bearing piece 14. In FIG. 3 this position is indicated by broken lines. The position shown by solid lines in FIG. 3 is the normal working position of the suction grip 12 in which its suction cup 24 is making suction contact with the sheet above it.

Another advantageous embodiment to achieve such a suction cup degree of freedom perpendicular to the support sheet 3 might be the use of so-called spring suction cups. A design of this type ensures an exact control of the up-and-down suction cup movement and permits more compact construction.

As shown in FIG. 3, the suction cup 24, to ensure a third degree-of-freedom, may be rotatable about its axis on the bushing 25 or on an arm 32 projecting sideways from the bushing. This avoids that during the alignment of misaligned sheets, relative movements develop between the suction cup 24 and the sheet held. This assures a careful operation even for cases of this type.

The air aspirated to generate suction contact required for sheet support by the suction grip in accordance with the invention flows via the suction holes 33 into a collector 34 of suction cup 24. The collector 34 is connected via a drill hole 35 in arm 35 to an annular space 36 which is formed by the bushing 25 and encloses guide rod 23. This is sealed off by packing sleeves 37 on the front side. The discharge opening 38 of an air channel 39 located in the guide rod 23 and produced by a drill hole discharges into the annular space. This achieves a simple reliable and space-saving air supply. The air channel 39 is connected to a vacuum source (for example, a pump, not shown) via a line 41 formed by a hose which can be connected to a connecting piece 40 of guide rod 23.

Figure 4:
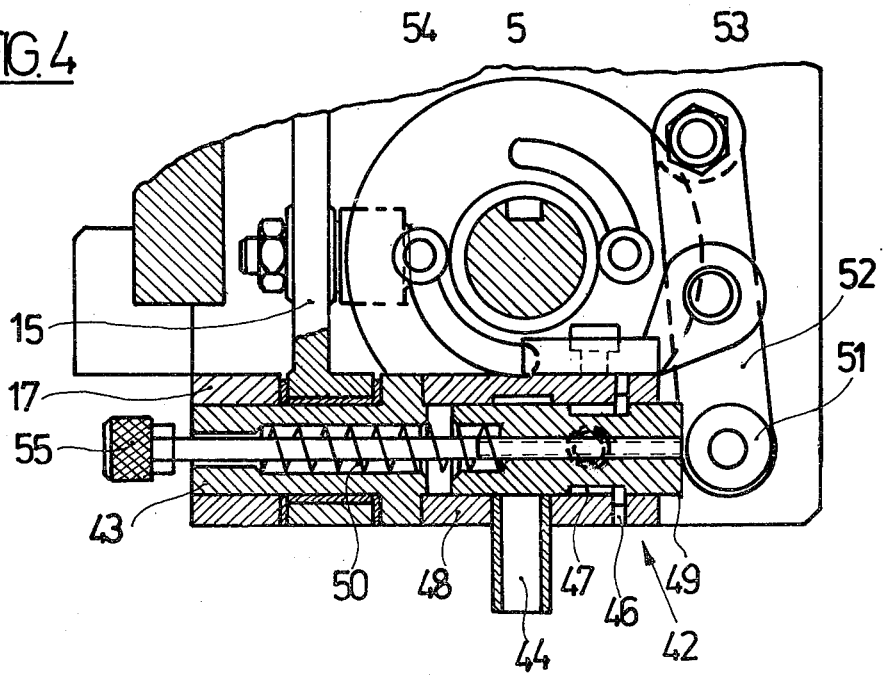
FIG. 4 shows a partial sectional view of the embodiment of FIG. 1 viewed in the direction of pull.

To control the underpressure, or, more precisely, the cyclical use of the underpressure, FIGS. 1 and 4 suggest a suitable control valve 42 placed in the air supply line which may be fastened, as suggested in FIG. 4, to the bearing rail 17 flanged to housing plate 2 or to the bearing pin 43 for mounting the rocker arm 15, or it may be an integral part thereof. The control valve 42 is a three-way valve of known design which has a connection 44 leading to the pump, a connection 45 to the hose, and another venting connection 46. The piston 49 of this control valve 43, moves in a cylinder 48 having control grooves 47, and it can be actuated against the force of a spring 50 by means of a rocker arm 52, which is located on the valve housing and equipped with a roller 51; this rocker arm with another roller 53 scans a control disk 54 driven by single-revolution shaft 5. The piston position may be made adjustable by means of an adjustment screw 55, etc. This makes possible fine adjustment of the control times. The control disks 10, 21 and 54 are, as shown in FIG. 4 on the control disk, adjustable in the peripheral direction. This already makes a reltively fine adjustment of the control times possible. A metering of the vacuum for bringing about a different slip (sliding) between sheet and suction cup is not necessary.

The drawing and the above description illustrate the advantageous functioning of the arrangement of the present invention. The sheets entering during the normal feed operation, with their edges to be aligned, into the gap formed by the supporting metal sheet 3 and the cover mask 7 (omitted in the figures for clarity's sake), are grasped by the suction grip 12 at their bottom side when the bearing piece 14 holding the suction grip 12 passes through its reversal point away from the stop strip 4. At the proper moment there is a vacuum pressure applied to suction cup 24 caused by the control curve 52 of the control valve 42. Then the sheet grasped and held at its bottom side is moved towards the stop strip 4 in accordance with the pivot motion of bearing piece 14 governed by control curve 20, until the outer sheet edge contacts the stop strip 4 and is thus aligned. After alignment, the suction grip 12 holding the sheet remains in this alignment position whereas the bearing piece can continue its movement towards the stop strip 4 till the reversal point close to the stop strip is reached. At about this time, the vacuum application is interrupted by the control valve 42 releasing the aligned sheet. The suction cup 24 previously holding the sheet to be aligned is lowered so that its outer edge is below the surface of the support sheet 3. In this position there takes place the return to the start position away from the stop strip 4. During this phase, the stop strip 4 and the contacting cover mask 7 is raised depending on the shape of the control disk, in order to make available a sufficiently wide entry gap. Then the next sheet is aligned.

The above describes a preferred embodiment of the invention, without constituting a restriction. Rather, the expert has a number of possibilities at his disposal in order to adapt the general idea of the invention to the individual case.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A sheet feeding arrangement with a device for lateral sheet alignment, comprising: a sheet stop strip; a pulling member actuated cyclically with said sheet feeding arrangement and moving back and forth transversely to the direction of sheet movement, said pulling member being arranged underneath a sheet to be aligned, said pulling member grasping the bottom of the sheet and pushing the sheet against said sheet stop strip; a bearing member moving back and forth transversely to the direction of sheet movement; said pulling member comprising a suction grip displaceably mounted on said bearing member; and adjustable spring means for actuating said suction grip in pull direction.

2. A sheet feeding arrangement as defined in claim 1 wherein said bearing member has a stop located forward in the pull direction and associated with said suction grip.

3. A sheet feeding arrangement as defined in claim 1, wherein said bearing member has a stop located forward in the pull direction and associated with said suction grip; said suction grip having a suction cup rotatable about an axis thereon; said suction cup being also movable perpendicular to the plane of the sheet; said suction grip being pivotably mounted on said bearing member; guide bushing means mounting said suction cup; said bearing member having a guide rod, said guide bushing means being freely movable on said guide rod; said suction cup being laterally offset relative to said guide bushing means; a vacuum source; said guide rod having an air supply channel connected to said vacuum source; said guide bushing having an annular space; said channel discharging into said annular space; two parallel rocking levers mounting said bearing member in parallelogram configuration; control cam means driven at predetermined speeds and cooperating with at least one rocking lever; said cam means comprising a control disc having a control curve in a closed groove; a sheet track; cover mask means moving cyclically up and down about said sheet track; said cover mask means being rigidly connected to said stop strip; a rocking lever for actuating said stop strip; and a control disc for controlling said rocking lever.

4. A sheet feeding arrangement as defined in claim 1, wherein said suction grip is held displaceably on said bearing member reciprocating with a fixed amplitude and having a degree of freedom, said suction grip being substantially independent of said reciprocating motion and being stopable at an instant at which said bearing member has not yet reached its rear reversal point so that it continues in movement with said suction grip remaining stationary, whereby movement of the suction grip holding the sheet from below terminates substantially immediately as soon as the lateral sheet edge has reached said sheet stop strip while said bearng member holding said suction grip can continue in motion, the ring falls on said suction grip being adjustable so that a safe edge contact at the sheet stop strip is maintained while preventing sheet buckling.

5. A sheet feeding arrangement as defined in claim 1 wherein said suction grip has a suction cup rotatable about an axis thereon.

6. A sheet feeding arrangement as defined in claim 5 wherein said suction cup is also movable perpendicular to the plane of the sheet.

7. A sheet feeding arrangement as defined in claim 6 wherein said suction grip is pivotably mounted on said bearing member.

8. A sheet feeding arrangement as defined in claim 7 including guide bushing means mounting said suction cup; said bearing member having a guide rod, said guide bushing means being freely movable on said guide rod.

9. A sheet feeding arrangement as defined in claim 8 wherein said suction cup is laterally offset relative to said guide bushing means.

10. A sheet feeding arrangement as defined in claim 8 including a vacuum source; said guide rod having an air supply channel connected to said vacuum source; said guide bushing having an annular space; said channel discharging into said annular space.

11. A sheet feeding arrangement as defined in claim 6 wherein said suction grip has a restricted pivoted motion.

12. A sheet feeding arrangement as defined in claim 1 wherein said suction grip comprises snap suction cup connected to an adjusting piston, said piston being extended upon application of vacuum for causing said suction cup to move.

13. A sheet feeding arrangement as defined in claim 1 including two parallel rocking levers mounting said bearing member in parallelogram configuration.

14. A sheet feeding arrangement as defined in claim 13 including control cam means driven at predetermined speeds and cooperating with at least one rocking lever.

15. A sheet feeding arrangement as defined in claim 14 wherein said cam means comprises a control disk having a control curve in a closed groove.

16. A sheet feeding arrangement as defined in claim 1 including a sheet track; and cover mask means moving cyclically up and down above said sheet track.

17. A sheet feeding arrangement as defined in claim 16 wherein said cover mask means is rigidly connected to said stop strip.

18. A sheet feeding arrangement as defined in claim 1 including a rocking lever for actuating said stop strip; and a control disk for controlling said rocking lever.

19. A sheet feeding arrangement as defined in claim 10 including a control valve in said air supply and having a control piston; a rocker arm for actuating said control piston; and control disk means for controlling said rocker arm and said control piston.

20. A sheet feeding arrangement as defined in claim 19 wherein said control disk is mounted on a single-revolution shaft having additional control disks mounted thereon.

* * * * *